US006280304B1

(12) United States Patent
Nakamura et al.

(10) Patent No.: US 6,280,304 B1
(45) **Date of Patent: *Aug. 28, 2001**

(54) ABRASIVE MACHINE

(75) Inventors: Yoshio Nakamura; Norihiko Moriya; Atsushi Kajikura, all of Nagano (JP)

(73) Assignee: Fujikoshi Kikai Kogyo Kabushiki Kaisha, Nagano (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/391,836

(22) Filed: Sep. 8, 1999

(51) Int. Cl.[7] ..... B24B 7/00

(52) U.S. Cl. ..... 451/261; 451/262; 451/288; 451/285

(58) Field of Search ..... 451/41, 285, 287, 451/288, 262–269, 290

(56) References Cited

U.S. PATENT DOCUMENTS 240,966 * 5/1881 Chappell ..... 451/262
3,537,214 * 11/1970 Ford ..... 451/265
5,762,543 * 6/1998 Kasprzyk et al. ..... 451/262

FOREIGN PATENT DOCUMENTS 48-94289 11/1973 (JP) .

* cited by examiner

*Primary Examiner*—Derris H. Banks
*Assistant Examiner*—Lee Wilson

(57) ABSTRACT

The abrasive machine of the present invention is capable of smoothly adjust the pressing force of an upper plate. The abrasive machine includes a plate supporting mechanism, which supports the upper polishing plate and is capable of adjusting a pressing force. The plate supporting mechanism comprises: a base frame; a cylinder unit being provided to an upper part of the base frame, ; a rotary plate being rotatably attached to a lower end of a piston rod of the cylinder unit; a plurality of connecting rods being pierced through the rotary plate, lower ends of the connecting rods being connected to the upper plate so as to rotate the upper plate together with the rotary plate; and a plurality of elastic members being provided between the stopper sections of the connecting rods and the rotary plate, whereby the pressing force of the upper plate is adjusted by adjusting a lifting force of the cylinder unit, which suspends the upper plate.

12 Claims, 6 Drawing Sheets

ABRASIVE MACHINE

BACKGROUND OF THE INVENTION

The present invention relates to an abrasive machine, more precisely relates to an abrasive machine, which sandwiches a work piece between a lower plate and an upper plate and relatively moves the two plates so as to abrade the work piece therebetween.

Conventionally, a thin plate work piece, e.g., a silicon wafer, is abraded by a lapping machine and polished by a polishing machine.

In the conventional lapping machine, for example, an external gear, which acts as a sun gear, and an internal gear are rotated at different angular velocity, so that each carrier plate, which holds the work pieces in through-holes, is rotated on its axis and moved round. Each carrier plate acts as a planet gear. The work pieces held by the carrier plates are sandwiched between an upper plate and a lower plate, which are respectively provided on the upper side and the lower side of the carrier plates. An abrasive agent (slurry) is supplied to spaces between the work pieces and the upper and lower plates. The upper and lower plates are relatively moved (rotated and/or swung) with respect to the work pieces, so that an upper face and a lower face of the work pieces can be simultaneously lapped.

By using the lapping machine, the work pieces can be precisely flatly lapped. Further, by simultaneously lapping the both faces of the work piece, working efficiency can be improved. The lapping machine has been employed, for example, to lap silicon wafers for semiconductor chips.

The conventional polishing machine generally has a rotary polishing plate, whose upper face is covered with a polishing cloth, and a holding unit including a holding plate. The holding plate is rotatably provided above the polishing plate, movable in the vertical direction and capable of holding the work pieces on a bottom face. Note that, the polishing plate corresponds to the lower plate; the holding plate corresponds to the upper plate. In the conventional polishing machine, the slurry is supplied, and the polishing plate is relatively moved with respect to the work pieces to polish a surface of the work pieces like mirror faces.

An example of the conventional lapping machine will be explained with reference to FIG. 6.

A bottom face of an upper plate 20 is an abrasive face, which laps upper faces of work pieces 10 (silicon wafers). Keys 21 are provided on an upper face of the upper plate 20.

A cylinder unit 22, e.g., a hydraulic cylinder unit, is provided to an upper part of a gate-shaped frame 14. The upper plate 20 is connected to a lower end of a piston rod 22*a* of the cylinder unit 22 by a rotary plate 23 and connecting rods 27. With this structure, the upper plate 20 is rotatably suspended. A connecting section 22*b* is fixed to the rotary plate 23, the piston rods 22*a* is not rotatable, and the rotary plate 23 and the upper plate 20, which are mutually connected by the connecting rods 27, are rotatably connected to the piston rod 22*b* without falling therefrom. The upper plate 20 applies a pressing force, which is caused by weight of the upper plate 20, to a lower plate 30. The pressing force can be adjusted by controlling a lifting force of the cylinder unit 22.

The keys 21 of the upper plate 20 are engaged with key grooves of a rotary member 54, which is rotated by a motor 70, so the upper plate 20 is rotated by the motor 70. A shaft 54*a* is downwardly extended from a lower end of the rotary member 54. A gear 54*b* is fixed to a lower end of the shaft 54*a*, and an idle gear 63 is engaged with the gear 54*b* and a gear 64, which is fixed to a spindle 60. With this structure, power of the motor 70 is transmitted to the upper plate 20 via the rotary member 54. By connecting the upper plate 20 to the rotary member 54 with the keys 21, a wide space for maintenance and setting the work pieces 10 can be formed between the upper plate 20 and the lower plate 30.

An external gear 50 is engaged with carrier plates 40. A first hollow shaft 50*a*, which is coaxial to the rotary shaft 54*a*, is connected to the external gear 50. A gear 50*b* of the first hollow shaft 50*a* is engaged with a gear 65 of the spindle 60.

A second hollow shaft 30*b*, which is coaxial to the first hollow shaft 50*a*, is connected to the lower plate 30. A gear 30*b*, which is fixed to a mid part of the second hollow shaft 30*a*, is engaged with a gear 61 of the spindle 60.

An internal gear 52 is engaged with the carrier plates 40. A third hollow gear 52*a*, which is coaxial to the second hollow shaft 30*a*, is connected to the internal gear 52. A gear 52*b* of the third hollow shaft 52*a* is engaged with a gear 62 of the spindle 60.

The spindle 60 is connected to a reduction gear system 69, and the reduction gear system 69 is connected to the motor, e.g., an electric motor, an oil motor, by a belt.

With the above described structure, the power of the motor 70 is transmitted by the reduction gear system 69, the gears and the shafts, so that the upper plate 20, the lower plate 30, the external gear 50 and the internal gear 52 are rotated.

In the conventional lapping machine, the pressing force of the upper plate 20, which is caused by the weight of the upper plate 20 and which presses the lower plate 30, is adjusted by controlling the lifting force of the cylinder unit 22. If fluid pressure in a lower chamber of the cylinder unit is made higher, the piston rod 22*a* is retracted into the cylinder unit 22 and the pressing force of the upper plate 20, which presses the lower plate 30, can be reduced. Namely, the maximum pressing force of the upper plate 20 is equal to the weight of the upper plate 20.

When silicon wafers are lapped by the lapping machine, there are minute projections and holes in surfaces of the silicon wafers 10. Firstly, the fluid pressure in the lower chamber of the cylinder unit 22 is made high so as to reduce the pressing force of the upper plate 20. The surfaces of the silicon wafers 10 are lapped with lower pressing force. Then, the fluid pressure in the cylinder unit 22 is gradually reduced so as to gradually increase the pressing force of the upper plate 20. By this control, the surfaces of the silicon wafers 10 are smoothly lapped and the silicon wafers have uniform thickness. In this state, the pressing force can be uniformly applied to the whole surfaces of the silicon wafers 10. Then, the entire weight of the upper plate 20 is applied to the lower plate 30 as the pressing force. Adjusting the pressing force should be executed smoothly.

However, in the conventional lapping machine, the pressing force of the upper plate 20 is adjusted by changing the fluid pressure in the cylinder unit 22, so mechanical resistance in the cylinder unit 22 influences the adjustment. Namely, it is difficult to precisely and linearly control the pressing force. Namely, the pressing force of the upper plate 20 is directly changed according to tensile stress of the piston rod 22*a*, and the pressing force of the upper plate 20 is changed while a bottom lapping face of the upper plate 20 contacts the work pieces 10. Thus, a stroke of a piston (not shown) in the cylinder unit 22 is equal to the sum total of amount of lapping (abrading) the wafer 10 and minute elastic elongation of the piston rod 22*a*. Namely, it is very very short.

It is difficult to perfectly smoothly move the piston due to friction between the piston and an inner circumferential face of the cylinder unit 22, so the piston is braked in the stroke. This phenomenon is called knocking. Even if the braking action is minute, the stroke of the piston is very very short, so the non-smooth action of the piston influences the pressing force of the upper plate 20. Therefore, it is very difficult to smoothly adjust the pressing force of the upper plate 20. The piston usually slides on the inner circumferential face of the cylinder unit 22 together with sealing members (not shown). The sealing members also cause the friction.

Further, it is very difficult to make the length of the connecting rods 27 perfectly same. The upper plate 20 is slightly inclined by the minute difference of the length thereof. If the upper plate 20 is inclined, the pressing force partially concentrates, so that the work pieces 10 cannot be uniformly lapped. Especially, in the case of lapping the silicon wafers, the lapping accuracy is quite high, e.g., sub-micron order, so it is more difficult to precisely lap the silicon wafers by the conventional lapping machine. And, it is also very difficult to realize the lapping machine for lapping large wafers.

SUMMARY OF THE INVENTION

An object of the present invention is to provide an abrasive machine, which is capable of smoothly adjust the pressing force of an upper plate so as to abrade work pieces with high abrasive accuracy.

Another object is to provide an abrasive machine, which is capable of preventing inclination of the upper plate so as to abrade work pieces with high abrasive accuracy.

To achieve the objects, the abrasive machine of the present invention has following structures.

Namely, the abrasive machine comprises:

a lower plate for holding a work piece;

an upper plate for pressing the work piece on the lower plate, the upper plate being relatively moved with respect to the lower plate so as to abrade the work piece; and a plate supporting mechanism supporting the upper polishing plate, the plate supporting mechanism being capable of adjusting a pressing force of the upper polishing plate, wherein the plate supporting mechanism comprises:

a base frame;

a cylinder unit being provided to an upper part of the base frame, a piston rod of the cylinder unit being capable of extending and retracting in the vertical direction;

a rotary plate being rotatably attached to a lower end of the piston rod of the cylinder unit;

a plurality of connecting rods being vertically and movably pierced through the rotary plate, lower ends of the connecting rods being connected to the upper plate so as to rotate the upper plate together with the rotary plate, upper ends of the connecting rods respectively having stopper sections, which prevents the connecting rods from falling off from the rotary plate; and a plurality of elastic members being respectively provided between the stopper sections of the connecting rods and the rotary plate, whereby the pressing force of the upper plate is adjusted by adjusting a lifting force of the cylinder unit, which suspends the upper plate.

In the abrasive machine, by the elastic members, the pressing force of the upper plate can be properly controlled by adjusting the lifting force of the cylinder unit. Namely, effective stroke of the piston rod can be made longer by the elastic members, so that the pressing force of the upper plate can be stably and smoothly changed. By the smooth change of the pressing force of the upper plate, the work pieces can be abraded with higher abrasive accuracy.

In the abrasive machine, the connecting rods may be circularly arranged,with regular angular separations, around the piston rod of the cylinder unit. With this structure, the work piece can be more uniformly abraded.

In the abrasive machine, the connecting rods may be circularly and radially arranged around the piston rod of the cylinder unit. With this structure, the pressing force of the upper plate can be uniformly applied.

In the abrasive machine, the connecting rods may be partially crowded, and the coefficient of elasticity of the coil springs in the crowded part may be smaller than that in other parts. With this structure, the upper plate can be suspended without inclination, so that the work piece can be uniformly abraded with higher abrasive accuracy.

In the abrasive machine, the connecting rods may be circularly and radially arranged, with regular angular and radial separations, around the piston rod of the cylinder unit so as to equalize the lifting force applied to the connecting rods. With this structure, the lifting force applied to the connecting rods can be equal, so that the work piece can be more uniformly abraded.

In the abrasive machine, the elastic members may be coil springs. With this structure, an effective stroke of the piston rod of the cylinder unit, which is the vertical stroke of the piston rod for adjusting the pressing force, can be longer, so that the pressing force of the upper plate can be smoothly adjusted and the work piece can be uniformly abraded with higher abrasive accuracy.

In the abrasive machine, abrasive faces may be respectively formed in an upper face of the lower plate and a lower face of the upper plate so as to simultaneously abrade both faces of the work piece. With this structure, working efficiency of the machine can be improved.

In the abrasive machine, the abrasive faces may simultaneously lap the both faces of the work piece which is formed into a thin plate, e.g., a silicon wafer.

BRIEF DESCRIPTION OF THE DRAWINGS

Embodiments of the present invention will now be described by way of examples and with reference to the accompanying drawings, in which.

DETAILED DESCRIPTION OF THE PREFERRED EMBODIMENTS

Preferred embodiments of the present invention will now be described in detail with reference to the accompanying drawings.

(First Embodiment)

Figure 1:
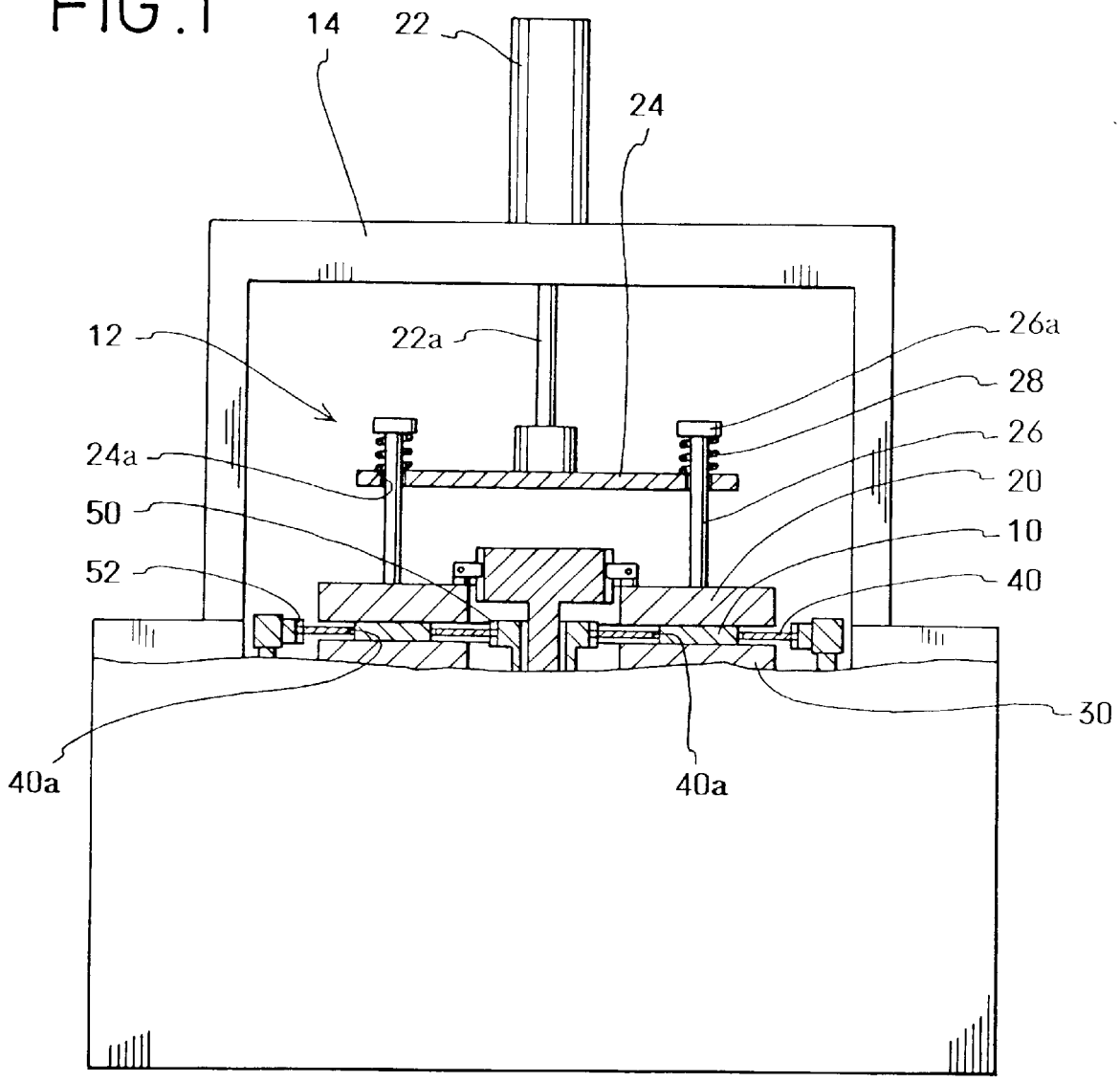
FIG. 1 is a front sectional view of a lapping machine of First Embodiment of the present invention.
Figure 2:
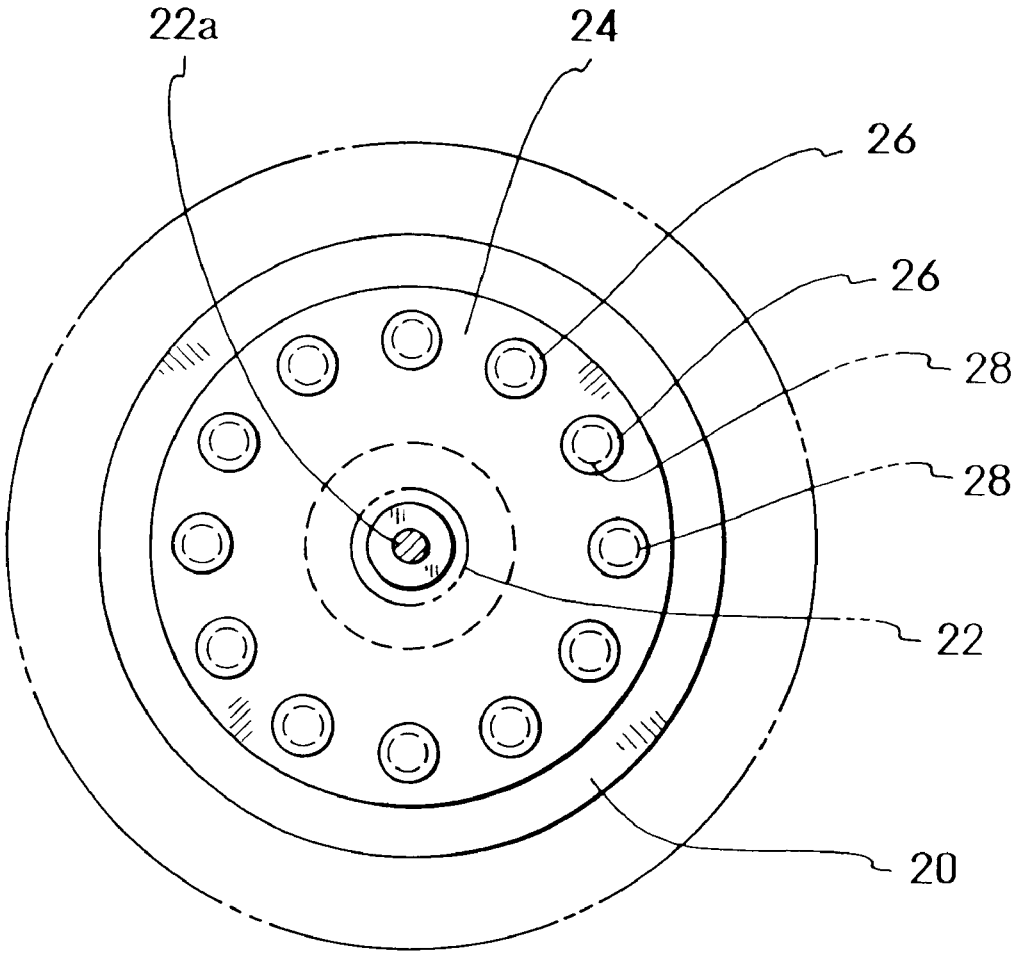
FIG. 2 is a plan view of a plate supporting mechanism of the First Embodiment.

First Embodiment will be explained with reference to FIGS. 1 and 2. FIG. 1 is a front sectional view of a lapping machine of the First Embodiment, in which a plate supporting is mainly shown. FIG. 2 is a plan view of a plate supporting mechanism of the First Embodiment.

Figure 6:
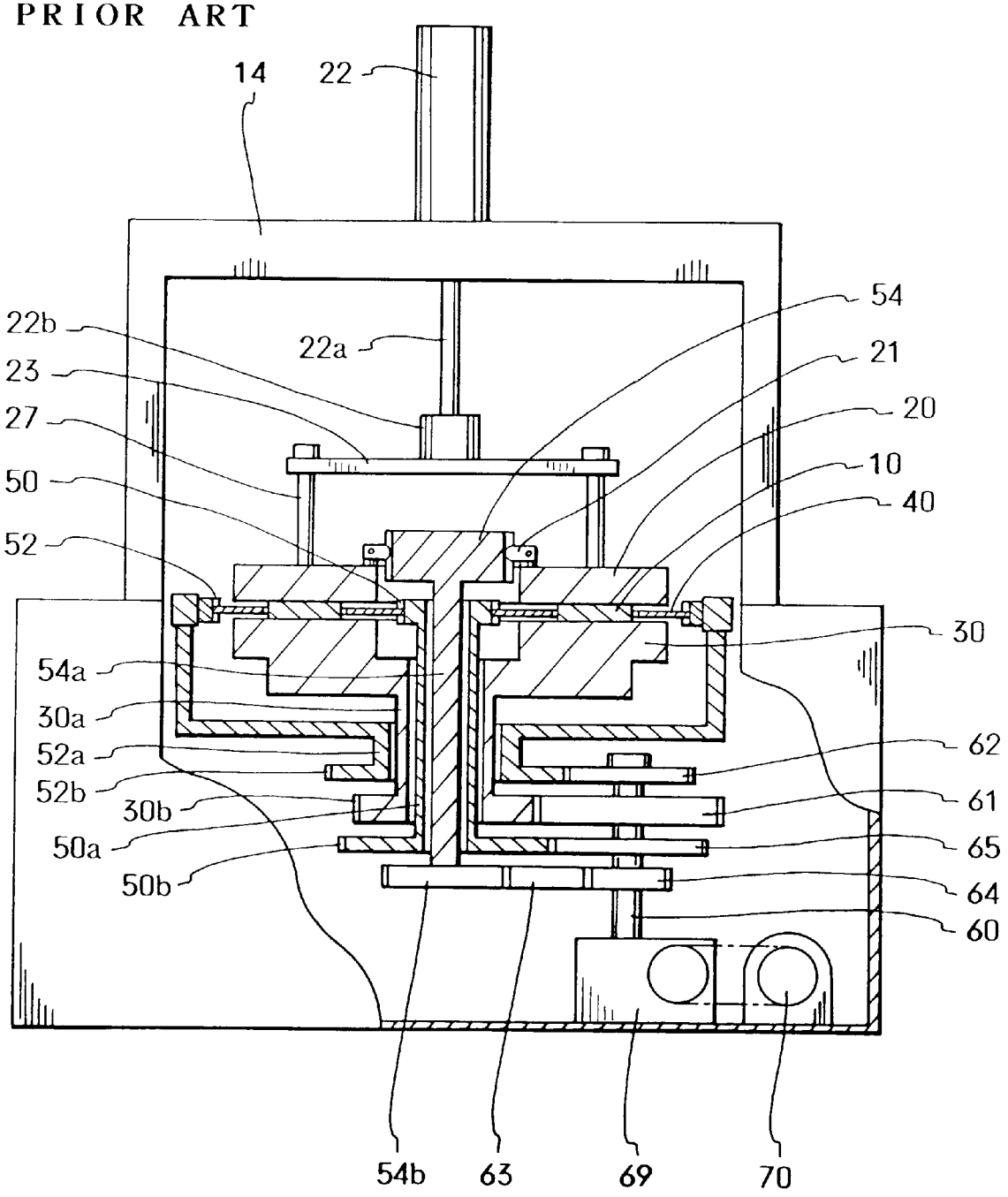
FIG. 6 PRIOR ART
FIG. 6 is a front sectional view of the conventional lapping machine.

In the First Embodiment, a lapping machine, which is capable of lapping both side faces of silicon wafers, will be explained as an example of abrasive machines. The lapping machine comprises: a lower plate 30 for holding work pieces 10 (silicon wafers); an upper plate 20 for pressing the work pieces 10 on the lower plate 30, the upper plate 20 being relatively moved with respect to the lower plate 30 so as to abrade the both side faces of the work pieces 10 sandwiched therebetween. Note that, the upper plate 20, the lower plate 30 and carrier plates 40 are driven by a driving mechanism, which includes an external gear and an internal gear as well as the conventional lapping machine shown in FIG. 6, so explanation will be omitted.

A plate supporting mechanism 12 includes a gate-shaped base frame 14 and a cylinder unit 22 being provided to a center part of an upper beam of the base frame 14. A piston rod 22*a* of the cylinder unit 22 is capable of extending and retracting in the vertical direction. The cylinder unit 22 is driven by compressed air, which is supplied from an air compressor (not shown). Note that, the cylinder unit 22 may be driven other fluid pressure means, e.g., a hydraulic system.

A rotary plate 24 is rotatably attached to a lower end of the piston rod 22*a* of the cylinder unit 22. The rotary plate 24 can be rotated about an axial line of the piston rod 22*a*. The rotary plate 24 is formed into a circular disk. To lighten the weight of the rotary plate 24, hollow spaces are formed therein; to increase the toughness of the rotary plate 24, ribs are formed therein.

A plurality of connecting rods 26 are vertically and movably pierced through the rotary plate 24. Lower ends of the connecting rods 26 are connected to the upper plate 20, so that t he upper plate 20 can be rotated, together with the rotary plate 24, about the axial line of the piston rod 22*a*. There are respectively formed stopper sections 26a at upper ends of the connecting rods 26. The stopper sections 26*a* prevents the connecting rods 26 from failing off from the rotary plate 24. In the present embodiment, a plurality of vertical through-holes 24*a* are bored in the rotary plate 24, and the connecting rods 26 are respectively pierced through the through-holes 24*a*. With this structure, the rotary plate 20 is connected with the upper plate by the connecting rods 26.

As shown in FIG. 2, 12 connecting rods 26 are circularly arranged, with regular angular separations, around the axial line of the piston rod 22*a* and the rotary plate 24.

A plurality of coil springs 26, which are an example of elastic members, are respectively provided between the stopper sections 26*a* of the connecting rods 26 and the rotary plate 24.

By employing the plate supporting mechanism 12, the upper plate is suspended, the pressing force of the upper plate 20, which is caused by the weight of the upper plate 20 and which is applied to the lower plate 30, can be adjusted by changing a lifting force of the cylinder unit 22, which lifts and suspends the upper plate 20.

Note that, number of the connecting rods 26 and the coil springs 28 is not limited to 12, they must be two or more.

The abrasive machine of the present embodiment is the lapping machine, so abrasive faces for abrading the work pieces 10 are respectively formed in an upper face of the lower plate 30 and a lower face of the upper plate 20, so that both side faces of each work piece 10 can be simultaneously abraded. Namely, the both side faces of the silicon wafers 10, which are made of a weak material, can be efficiently lapped, with high lapping accuracy, by the lapping machine of the present embodiment.

Successively, action of the lapping machine of the present embodiment will be explained.

When the work pieces 10 are respectively set in through-holes 40*a* of the carrier plates 40, which has been mounted on the lower plate 30, the piston rod 22*a* of the cylinder unit 22 has been retracted in the cylinder unit 22, so that a large space can be formed between the upper plate 20 and the lower plate 30. In this state, the entire weight of the upper plate 20 is supported by the coil springs 26, so the coil springs 26 are compressed most. Generally, number of the through-holes 40*a* of each carrier plate 40 is five or more. The lapping machine usually holds four or five carrier plates 40, so 20 or more work pieces 10 can be simultaneously lapped.

After the work pieces 10 are set on the lower plate 30, inner air pressure of a lower chamber of the cylinder unit 22 is reduced so as to downwardly move the upper plate 20 until the abrasive face of the upper plate 20 contacts upper faces of the work pieces 10. There are minute projections and holes in the faces of the work pieces (silicon wafers) 10 before lapping. So, if a greater pressing force of the upper plate 20 is applied to the work pieces 10 which has not been lapped, the pressing force is concentrated to the minute projections, so that the work pieces 10 are broken. Therefore, at the beginning of the lapping the work pieces 10, the inner air pressure of the cylinder unit 22 is high, e.g., 5 $kgf/cm^2$, so as to reduce the force pressing the work pieces 10. At that time, the weight supported by the coil springs 28 is the weight of the upper plate 20 minus the weight (= the pressing force) working to the work pieces 10. So, the coil springs 28 slightly extend from the most compressed state.

Next, the inner air pressure of the cylinder unit 22 is gradually reduced so as to increase the pressing force of the upper plate 20, which presses the work pieces 10. Namely, the lapping machine laps the work pieces 10 with gradually increasing the pressing force. Note that, the upper plate 20, the lower plate 30 and carrier plates 40 are driven by the driving mechanism, which includes the external gear and the internal gear as well as the conventional lapping machine shown in FIG. 6, so explanation will be omitted.

When roughness of the both faces of the work pieces 10 reaches a certain degree and they have uniform thickness, the pressing force can be uniformly applied to the whole face of each work piece 10. Then, the inner air pressure of the cylinder unit 22 is controlled so as to apply the entire weight of the upper plate 20 as the pressing force. Namely, the inner air pressure may be zero.

While the inner air pressure of the cylinder unit 22 is gradually reduced, the weight working to the coil springs 26 is gradually converted into the pressing force working to the work pieces 10, so the load of the coil springs 28 is gradually reduced. Therefore, the coil springs id gradually extend. The extending length of the coil springs 26 correspond to the extending length of the piston rod 22*a*. Namely, the effective stroke of the piston rod 22*a* is equal to the extending stroke of the coil springs 28. The effective stroke of the piston rod 22*a* of the present embodiment is much longer than that of the conventional one shown in FIG. 6.

In the present embodiment, the inner air pressure of the cylinder unit 22 can be controlled within the long effective stroke of the piston rod 22*a*, so the mechanical resistance of a piston (not shown), etc. do not badly influence and the pressing force of the upper plate 20 can be smoothly changed. Therefore, the work pieces 10 can be lapped with higher lapping accuracy.

Even if the length of the connecting rods 26 are slightly different, the weight of the upper plate 20 (the load) is properly dispersed to a plurality of the coil springs 28, so that the work pieces 10 are uniformly pressed. The extending strokes of the coil springs 26 are much longer than the difference of the length of the connecting rods 26, so the difference can be easily absorbed. If the rotary plate 24 and the upper plate 20 are merely connected by the connecting rods 26 without the coil springs 26, the pressing force concentrates to the longest connecting rod 26 when the abrasive face of the upper plate 20 contacts the work pieces 10. But, in the present embodiment, the pressing force can be properly dispersed by the coil springs 28.

By employing the coil springs 26, the upper plate 20 can be stably horizontally suspended, so no unbalanced force works to the piston of the cylinder unit 22. Therefore, the mechanical resistance of the cylinder unit 22 can be reduced, the pressing force of the upper plate 20 can be stably and smoothly changed, and the work pieces 10 can be lapped with high lapping accuracy.

(Second Embodiment)

Figure 3:
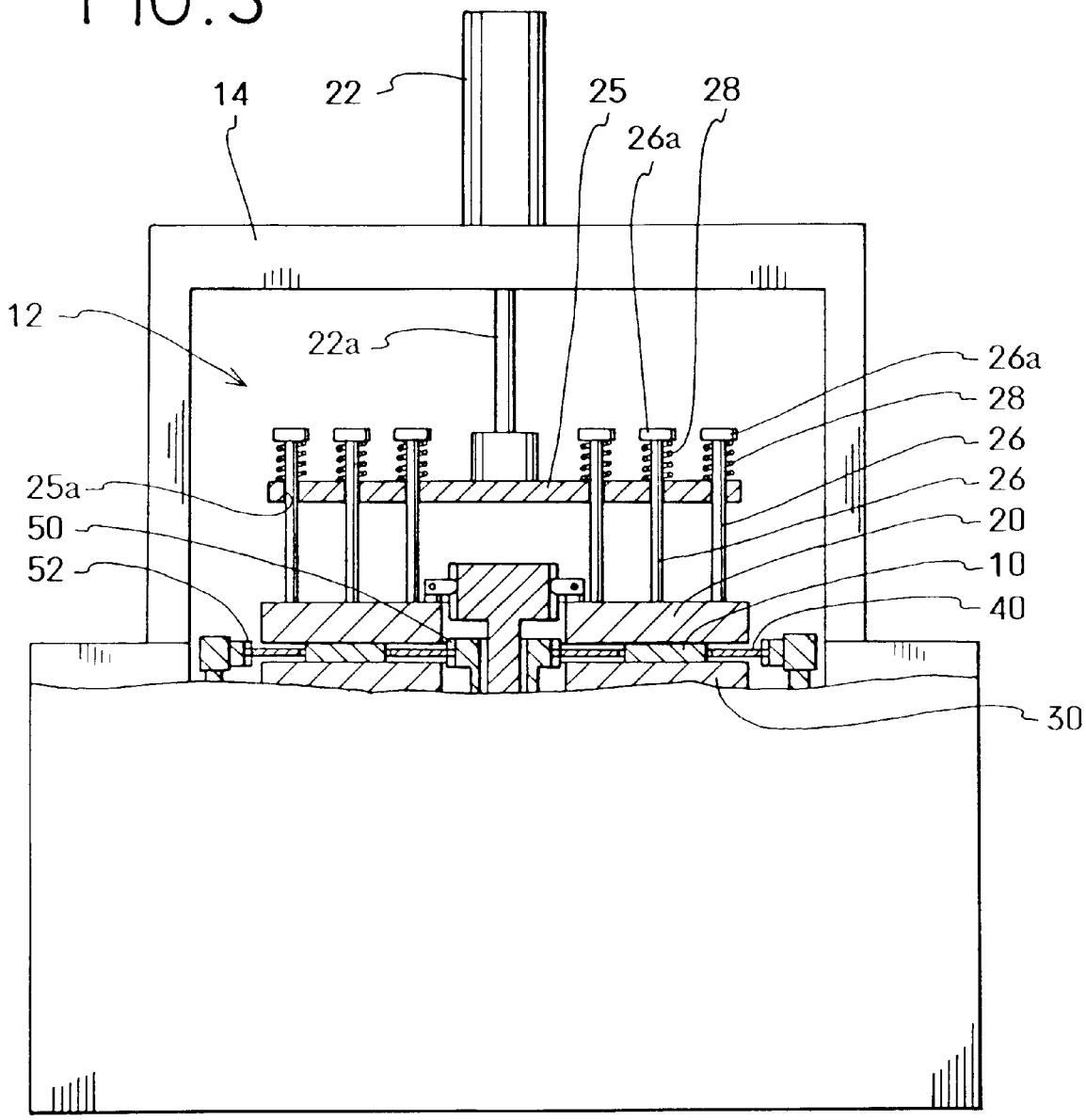
FIG. 3 is a front sectional view of a lapping machine of Second Embodiment of the present invention.
Figure 4:
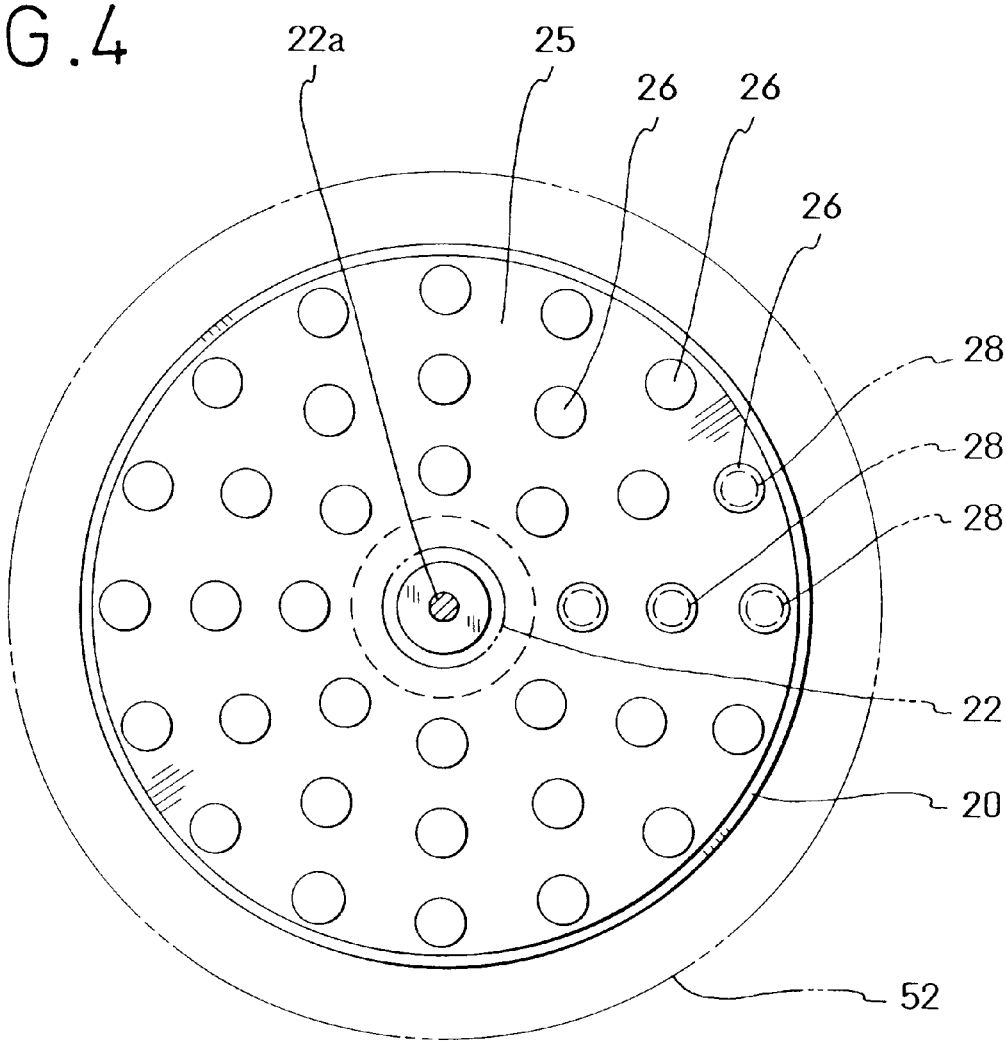
FIG. 4 is a plan view of a plate supporting mechanism of the Second Embodiment.

Second Embodiment will be explained with reference to FIGS. 3 and 4. FIG. 3 is a front sectional view of a lapping machine of the Second Embodiment, in which a plate supporting is mainly shown. FIG. 4 is a plan view of a plate supporting mechanism of the Second Embodiment. Note that, elements shown in FIGS. 1 and 2 (the First Embodiment) are assigned the same symbols and explanation will be omitted.

The features of the Second Embodiment is an arrangement of the connecting rods 26.

To equalize the lifting force applied to each connecting rod 26, the connecting rods 26 are circularly and radially arranged, with regular angular and radial separations, around the axial line of the piston rod 22*a* of the cylinder unit 22. Namely, the connecting rods 26 are located along three coaxial virtual circles, which are coaxial to the piston rod 22*a* and mutually separated with regular radial separations. There are eight connecting rods 26 are arranged, with regular angular separations, along the inner virtual circle; there are 12 connecting rods 26 are arranged, with regular angular separations, along the middle virtual circle; and there are 16 connecting rods 26 are arranged, with regular angular separations, along the outer virtual circle.

With this arrangement, the lifting force or the load applied to each connecting rod 26 is equalized. Especially, by employing the elastic members, inclination of the upper plate 20 can be prevented; the upper plate 20 can be stably horizontally suspended.

A rotary plate 25 has a plurality of through-holes 25*a*, which are circularly and radially arranged. The connecting rods 26 are respectively pierced through the through-holes 25*a*. Unlike the First Embodiment in which the connecting rods 26 are circularly arranged only, the through-holes 25*a* of the Second Embodiment are circularly and radially arranged.

The coil springs 26, which are the example of the elastic members, are respectively provided between the stopper sections 26*a* of the connecting rods 26 and the rotary plate 25 as well as the First Embodiment.

In the present embodiment, number of the connecting rods 26 and the coil springs 28 are 36, but the number is not limited to 36.

The action of the lapping machine will be explained.

The plate supporting mechanism 12 suspends the upper plate 20, and the pressing force of the upper plate 20, which is caused by the weight of the upper plate 20, can be adjusted by changing the lifting force of the cylinder unit 22 as well as the First Embodiment.

The upper plate 20 can be stably horizontally suspended by the coil springs 26, so no unbalanced force works to the piston (not shown) of the cylinder unit 22. Therefore, the mechanical resistance of the cylinder unit 22 can be reduced, the pressing force of the upper plate 20 can be stably and smoothly changed, and the work pieces 10 can be lapped with high lapping accuracy.

Further, the coil springs 28 are arranged with the regular circular separations and the regular radial separations, the coil springs 28 can uniformly receive and disperse the weight of the upper plate 20. Namely, the springs 28 prevent the weight from concentrating to a specific connecting rod 26 and disperse the weight broadly. With this structure, the whole upper face of the upper plate 20 can be uniformly suspended or lifted, so that the inclination of the upper plate 20 can be prevented and the work pieces 10 can be lapped with high lapping accuracy.

(Third Embodiment)

Figure 5:
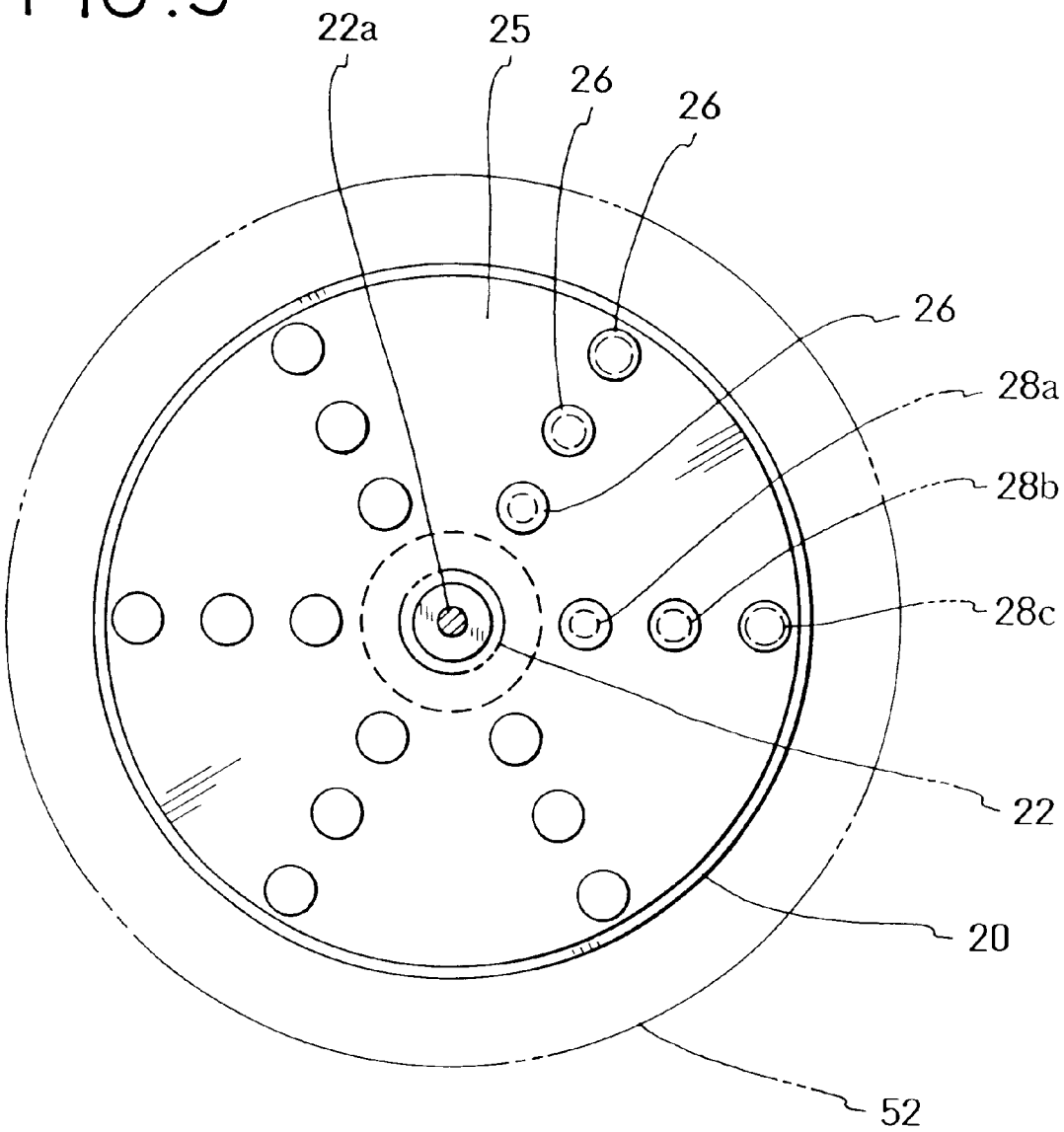
FIG. 5 is a plan view of a plate supporting mechanism of the Third Embodiment.

Third Embodiment will be explained with reference to FIG. 5. FIG. 5 is a plan view of a lapping machine of the Third Embodiment. Note that, elements shown in FIGS. 1-4 (the First and Second Embodiments) are assigned the same symbols and explanation will be omitted.

In the Third Embodiment, the connecting rods 26 are partially crowded. The coefficient of the elasticity of the coil springs 28*a* in the crowded part is smaller than that of the coil springs 28*c* in non-crowded parts.

In the present embodiment, the connecting rods 26 are located along three coaxial virtual circles, which are coaxial to the piston rod 22*a* and mutually separated with regular radial separations. There are six connecting rods 26 are arranged, with regular angular separations, along each virtual circle. The coefficient of the elasticity of the coil springs 28*a*, which are provided to the connecting rods 26 arranged along the inner victual circle, is small; the coefficient of the elasticity of the coil springs 28*b*, which are provided to the connecting rods 26 arranged along the middle virtual circle, is greater than that of the coil springs 28*a*; and the coefficient of the elasticity of the coil springs 28*c*, which are provided to the connecting rods 26 arranged along the outer virtual circle, is greater than that of the coil springs 28*b*.

With this structure, the whole upper face of the upper plate 20 can be uniformly suspended or lifted, even if the coil springs 28 are not arranged with regular separations. By the uniform suspension, the inclination of the upper plate 20 can be prevented and the work pieces 10 can be lapped with high lapping accuracy.

In the present embodiment, the connecting rods 26 are located along three coaxial virtual circles, but the arrangement is not limited, the connecting rods 26 may be located, for example, along two or four coaxial virtual circles. The connecting rods 26 should be radially arranged along two or more coaxial polygons or circles.

In the above described embodiments, the connecting rods 26 are merely pierced through the through-holes 24*a* or 25*a*. Linear bushes, convex bearings or combined bearings of the both may be fit in the through-holes 24*a* and 25*a*. By employing the linear bushes, the vertical movement of the connecting rods 26 can be more smooth. The convex bearings can correspond to the inclination of the connecting rods 26. To limit the vertical movement of the connecting rods 26, stopper means may be provided to the connecting rods 26.

The coil springs 28 are employed as the elastic members, but other means, e.g., air bags, rubber members, may be employed as the elastic members. In the case of employing the air bags into which compressed fluid is supplied, a distributor is required because the air bags are mounted on the rotary plate 24 or 25. In the case of employing the rubber members, it is difficult to gain long strokes, so the coil springs 28 are proper elastic members.

The shape of the base frame is not limited to the gate-shaped base frame 14. For example, an inverted L-shaped base frame may be employed. But the gate-shaped base frame is proper to suspend a heavy cylinder unit.

The upper plate 20, the lower plate 30 and the carrier plate 40 are driven by one motor 70 (see FIG. 3). But they may be independently driven by three motors.

In the above described embodiments, the lapping machines have been described as the abrasive machines of the present invention, but the features of the present invention may be employed other abrasive machines, e.g., polishing machines.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. An abrasive machine, comprising:

a lower plate for holding a work piece;

an upper plate for pressing the work piece on said lower plate, said upper plate being relatively moved with respect to said lower plate so as to abrade the work piece; and a plate supporting mechanism supporting said upper polishing plate, said plate supporting mechanism being capable of adjusting a pressing force of said upper polishing plate, said plate supporting mechanism including:

a base frame;

a cylinder unit provided at an upper part of said base frame, a piston rod of said cylinder unit being capable of extending and retracting in the vertical direction;

a rotary plate rotatably attached to a lower end of the piston rod of said cylinder unit;

connecting rods vertically and movably extending through said rotary plate, lower ends of said connecting rods being fixably connected to said upper plate so as to rotate said upper plate together with said rotary plate while allowing relative vertical movement therebetween, upper ends of said connecting rods respectively having stopper sections which prevent detachment of said connecting rods from said rotary plate; and elastic members being respectively provided between the stopper sections of said connecting rods and said rotary plate, such that said upper plate is supported by said cylinder unit, and a weight of said upper plate is gradually applied to said lower plate via said elastic members which are provided between said rotary plate and the stopper sections of said connecting rods to receive the weight.

2. The abrasive machine according to claim 1, wherein said elastic members are coil springs.

3. The abrasive machine according to claim 1, wherein said connecting rods are circularly arranged, with regular angular separations, around the piston rod of said cylinder unit.

4. The abrasive machine according to claim 3, wherein said elastic members are coil springs.

5. The abrasive machine according to claim 1, wherein said connecting rods are circularly and radially arranged around the piston rod of said cylinder unit.

6. The abrasive machine according to claim 5, wherein said elastic members are coil springs.

7. The abrasive machine according to claim 6, wherein said connecting rods are closer together in a particular region of said upper plate than in another region of said upper plate, the coefficient of elasticity of said coil springs in the particular region being smaller than that provided in said another region.

8. The abrasive machine according to claim 1, wherein said connecting rods are circularly and radially arranged, with regular angular and radial separations, around the piston rod of said cylinder unit so as to equalize the lifting force applied to said connecting rods.

9. The abrasive machine according to claim 8, wherein said elastic members are coil springs.

10. The abrasive machine according to claim 1, wherein abrasive faces are respectively formed in an upper face of said lower plate and a lower face of said upper plate, whereby both faces of the work piece can be simultaneously abraded.

11. The abrasive machine according to claim 10, wherein said abrasive faces simultaneously lap the both faces of the work piece which is formed into a thin plate.

12. In an abrasive machine which includes a lower plate for holding a work piece and an upper plate for pressing the work piece on the lower plate, the upper plate being relatively moved with respect to said lower plate so as to abrade the work piece, a plate supporting mechanism for supporting said upper polishing plate, comprising:

a base frame;

a cylinder unit disposed at an upper part of said base frame, said cylinder unit including a piston rod capable of extending and retracting in a vertical direction;

a rotary plate rotatably attached to a lower end of the piston rod of said cylinder unit;

connecting rods vertically extending through said rotary plate and vertically movable with respect thereto,lower ends of said connecting rods being fixably attached to the upper plate so as to collectively rotate said upper plate together with said rotary plate while allowing relative vertical movement therebetween, upper ends of said connecting rods respectively having stopper sections which prevent detachment of said connecting rods from said rotary plate; and elastic members disposed between the stopper sections of said connecting rods and said rotary plate, such that said upper plate is supported by said cylinder unit, and a weight of said upper plate is gradually applied to said lower plate via said elastic members when moved in a direction of said lower plate.

* * * * *